US010299532B2

(12) United States Patent
Cherosky et al.

(10) Patent No.: US 10,299,532 B2
(45) Date of Patent: May 28, 2019

(54) WATER-PROOF PROTECTIVE SHOE COVERING

(71) Applicants: David Cherosky, Kirtland, OH (US); Kevin Carroll, Twinsburg, OH (US)

(72) Inventors: David Cherosky, Kirtland, OH (US); Kevin Carroll, Twinsburg, OH (US)

( * ) Notice: Subject to any disclaimer, the term of this patent is extended or adjusted under 35 U.S.C. 154(b) by 0 days.

(21) Appl. No.: 14/079,737

(22) Filed: Nov. 14, 2013

(65) Prior Publication Data

US 2014/0137430 A1 May 22, 2014

Related U.S. Application Data

(60) Provisional application No. 61/726,285, filed on Nov. 14, 2012.

(51) Int. Cl.

| | |
|---|---|
| ***A43B 7/12*** | (2006.01) |
| ***A43B 3/16*** | (2006.01) |
| ***A43B 1/00*** | (2006.01) |
| ***A43B 1/10*** | (2006.01) |
| ***A43B 1/14*** | (2006.01) |
| ***A43B 3/00*** | (2006.01) |
| ***A43B 3/06*** | (2006.01) |
| ***A43B 3/08*** | (2006.01) |
| ***A43B 3/18*** | (2006.01) |
| ***A43B 5/18*** | (2006.01) |

(52) U.S. Cl.
CPC . *A43B 7/12* (2013.01); *A43B 3/16* (2013.01)

(58) Field of Classification Search
CPC ..... A43B 1/0081; A43B 1/10; A43B 1/14; A43B 3/0031; A43B 3/06; A43B 3/08; A43B 3/16; A43B 3/18; A43B 5/18; A43B 7/12; A43B 23/06
USPC ..... 36/7.1 R, 87, 7.4, 7.3, 4, 43
See application file for complete search history.

(56) References Cited

U.S. PATENT DOCUMENTS

| | | | | | |
|---|---|---|---|---|---|
| 1,637,027 | A * | 7/1927 | Piper | A43B 3/16 | 12/142 EV |
| 2,235,490 | A * | 3/1941 | Saksa | A43B 3/16 | 36/1 |
| 2,347,191 | A * | 4/1944 | McGillicuddy | A43B 3/16 | 36/7.3 |
| 2,435,485 | A * | 2/1948 | Wheaton | A43B 3/16 | 36/57 |
| 3,875,687 | A * | 4/1975 | Henderson | A43B 5/0415 | 36/7.1 R |
| 4,392,311 | A * | 7/1983 | Rudolf | A43B 3/16 | 36/50.1 |
| 4,713,895 | A | 12/1987 | Vallieres | | |
| 4,896,438 | A | 1/1990 | DeBease | | |
| 5,694,703 | A * | 12/1997 | Diaz | A43B 3/163 | 36/7.1 R |

(Continued)

*Primary Examiner* — Alissa J Tompkins
*Assistant Examiner* — Cameron A Carter
(74) *Attorney, Agent, or Firm* — Calfee, Halter & Griswold LLP

(57) ABSTRACT

A water-proof protective overshoe adapted to be worn over shoes to keep the shoes warm and dry is provided. The water-proof protective overshoe includes a body portion and a sole portion. The body portion may include one or more opening means, such as zippers, and one or more tightening means. The protective overshoes may be quickly put on and removed. The protective overshoe is adapted for use by players on the sidelines of an athletic game or match.

16 Claims, 5 Drawing Sheets

(56) References Cited

U.S. PATENT DOCUMENTS 5,913,592 A * 6/1999 Moore ..... A43B 7/26 36/4
6,038,792 A 3/2000 Hauter
6,715,220 B1 * 4/2004 Isenberg ..... A43B 1/0036 36/136
7,383,646 B2 6/2008 Hall
9,408,436 B2 * 8/2016 Mankowski ..... A43B 7/34
2002/0017035 A1 * 2/2002 Treptow ..... A43B 7/02 36/2.6
2002/0178621 A1 * 12/2002 Darby ..... A43B 3/128 36/140
2003/0097766 A1 * 5/2003 Morgan ..... A43B 5/04 36/10
2003/0154626 A1 * 8/2003 Larson ..... A43B 3/16 36/7.6
2003/0154630 A1 * 8/2003 Lewis ..... A43B 1/0081 36/97
2004/0250452 A1 * 12/2004 Farys ..... A43B 5/002 36/89
2005/0022430 A1 * 2/2005 Terry ..... A43B 1/0081 36/72 R
2005/0034331 A1 * 2/2005 Allen ..... A43B 1/00 36/97
2005/0091880 A1 * 5/2005 Harris ..... A43B 3/0005 36/2.6
2005/0166426 A1 * 8/2005 Donnadieu ..... A43B 5/0411 36/50.5
2005/0210704 A1 * 9/2005 Connolly ..... A43B 3/0031 36/2.6
2007/0113424 A1 * 5/2007 Bell ..... A43B 3/16 36/7.3
2007/0163145 A1 * 7/2007 Lavers ..... A41B 11/008 36/4
2007/0175064 A1 * 8/2007 Culton ..... A43B 1/0081 36/7.1 R
2007/0186449 A1 * 8/2007 Wilcots ..... A41D 17/00 36/2 R
2008/0000102 A1 * 1/2008 Rastegar ..... A43B 1/0027 36/7.6
2008/0072453 A1 * 3/2008 Mizrahi ..... A43B 1/0045 36/44
2009/0025257 A1 * 1/2009 Peroni et al. ..... 36/83
2009/0049710 A1 * 2/2009 Barnett ..... A41D 15/00 36/1.5
2009/0083996 A1 * 4/2009 Clancy ..... A43B 5/08 36/88
2009/0147430 A1 * 6/2009 Norton ..... A43B 1/009 361/223
2010/0050470 A1 * 3/2010 Hubner ..... 36/14
2012/0246971 A1 * 10/2012 Donzis ..... A43B 7/1425 36/43

* cited by examiner

WATER-PROOF PROTECTIVE SHOE COVERING

The present application claims priority to U.S. provisional application No. 61/726,285, filed on Nov. 14, 2012, titled "Water-Proof Protective Shoe Covering", which is incorporated by reference in its entirety.

FIELD

The present invention relates generally to a protective shoe-covering and more particularly to a water-proof shoe-covering for providing waterproof protection against poor weather conditions for athletes and spectators.

BACKGROUND

Athletic shoes in today's age are viewed as being essential when it comes to playing an athletic sport, running, and training of any kind. Shoes coming in many varieties possessing various properties designed for optimal performance in a particular sport. For instance, basketball shoes are flexible and cushioned for optimal jumping ability and agility. Soccer cleats dig into dirt for maximized grip. However, most athletic shoes are not water-proof and athletes that participate in outdoor activities often have to endure wet, cold feet during times of inclement weather.

Athletic shoes are increasingly being made more lightweight to provide less resistance and improved performance. Lightweight shoes often include thinner soles and/or sidewalls. Additionally, shoes may include mesh or holes in the outer body of the shoe, which helps reduce the weight of the shoe, but also further reduce the warmth and protection afforded to a foot from poor weather conditions.

Unfavorable weather impacts many facets of an outdoor activity or sporting event, and particularly affects athletes, coaches, trainers, reporters, and spectators. During sporting events, such as soccer and football, athletes are constantly entering and exiting the game, and such transitions happen very quickly. As the athletes exit the game, they may stand or sit on the sidelines for a period of inactivity before re-entering the game. During this time, the athlete may be exposed to wet, cold, muddy, and often snowy conditions that may negatively affect the player when re-entering the game.

Protective overshoes have been designed for use during the performance of an activity. Such overshoes, however, do not afford a quick, easy mechanism for putting on or taking off the overshoe. Without a quick and easy way to put on or take off such overshoes, such overshoes are not optimally suited for wear by athletes who may desire to quickly put on the overshoe when exiting a game and remove the overshoe quickly to enter a game. Wearing a protective covering over an athletic shoe may negatively impact the performance properties of the shoe and the athlete wearing the shoe. Additionally, although conventional overshoes may provide protection from weather elements, the overshoes do not provide a warming mechanism, which may help dry a wet athletic shoe and provide warmth to a foot and improve a user's performance.

SUMMARY OF THE INVENTION

The general inventive concepts include a water-proof protective overshoe adapted to be worn over shoes to keep the shoes warm and dry. In some exemplary embodiments, the water-proof protective overshoe includes a body portion and a sole portion. The body portion may include one or more opening means, such as zippers, and one or more tightening means. The inventive protective overshoes may be quickly put on and removed. In some exemplary embodiments, the protective overshoe is adapted for use by players on the sidelines of an athletic game or match.

In some exemplary embodiments, the inventive waterproof overshoe further includes a removable sole insert. The removable sole insert may include one or more pockets designed to accept a warming or cooling device. In some exemplary embodiments, the removable sole insert further includes a base portion formed from an insulative material.

The general inventive concepts further include a protective shoe covering that includes a waterproof overshoe including a body portion and a sole portion. The body portion includes at least one opening means and at least one tightening means.

The foregoing and other objects, features, and advantages of the general inventive concepts will become more readily apparent from a consideration of the detailed description that follows.

BRIEF DESCRIPTION OF THE DRAWINGS

FIG. 1(*b*) illustrates a side view of an exemplary inner sole insert in accordance with one aspect of the present invention.

DETAILED DESCRIPTION

The present invention will now be described with occasional reference to exemplary embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. As used in the description of the invention and the appended claims, the singular forms "a," "an," and "the" are intended to include the plural forms as well, unless the context clearly indicates otherwise.

Unless otherwise indicated, all numbers expressing quantities in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention.

The general inventive concepts relate to a protective overshoe for covering a shoe. The protective overshoe may be used with any variety of shoe without limitation. For example, the protective overshoe may be used as a covering for athletic shoes, such as running shoes, cleats, and spikes. The protective overshoe will be described herein for use with a soccer cleat, although it is to be understood that any variety of shoes may alternatively be used.

In some exemplary embodiments, the protective overshoe is designed to snugly fit over cleats, keeping the user's feet warm and dry and protecting the cleats from the inclement weather conditions of a playing field or arena. The protective overshoe provides the benefit of being quick and easy to put on and remove, such that an athlete can easily put the overshoe on when on the sidelines and remove the overshoe when entering back into a playing field or arena.

Figure 1B:
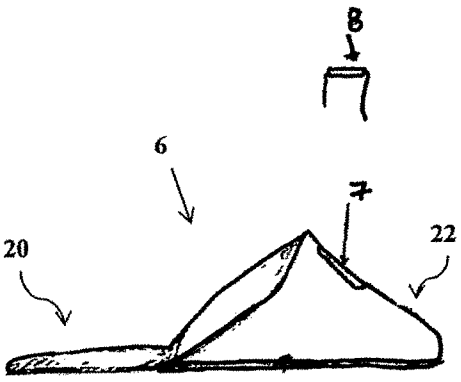
FIG. 1(*a*) illustrates a side perspective view of one exemplary embodiment of a protective overshoe according to one aspect of the present invention.
Figure 1A:
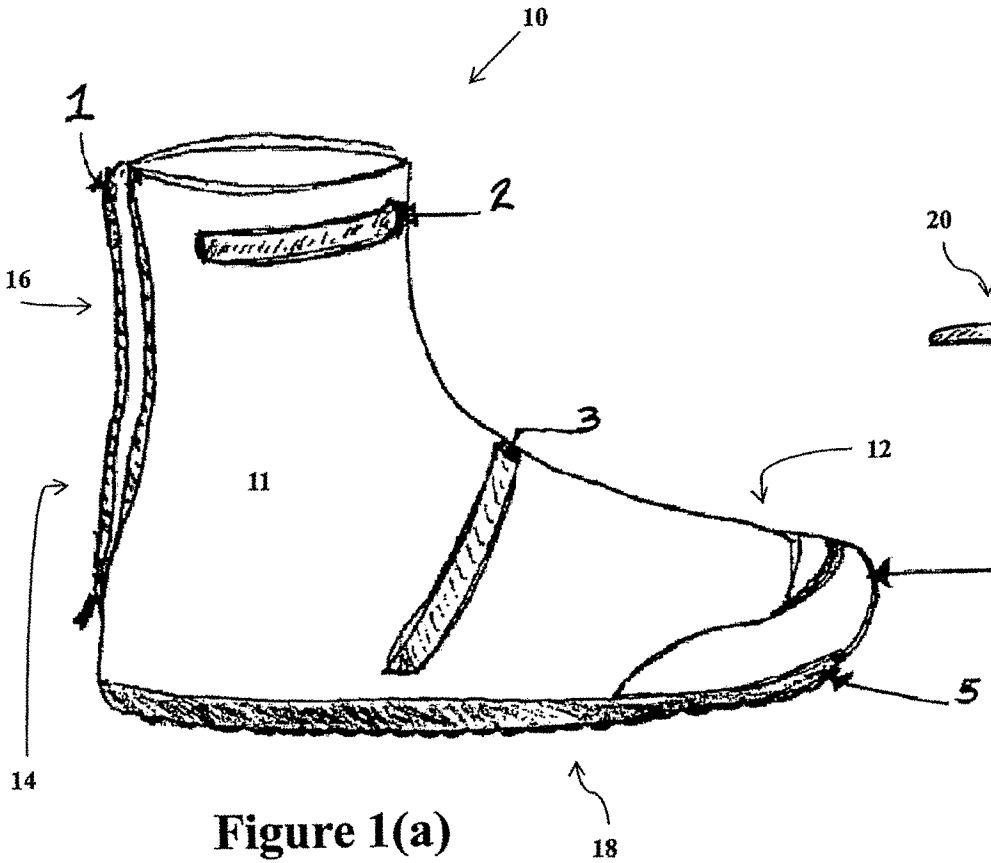
Figure 2:
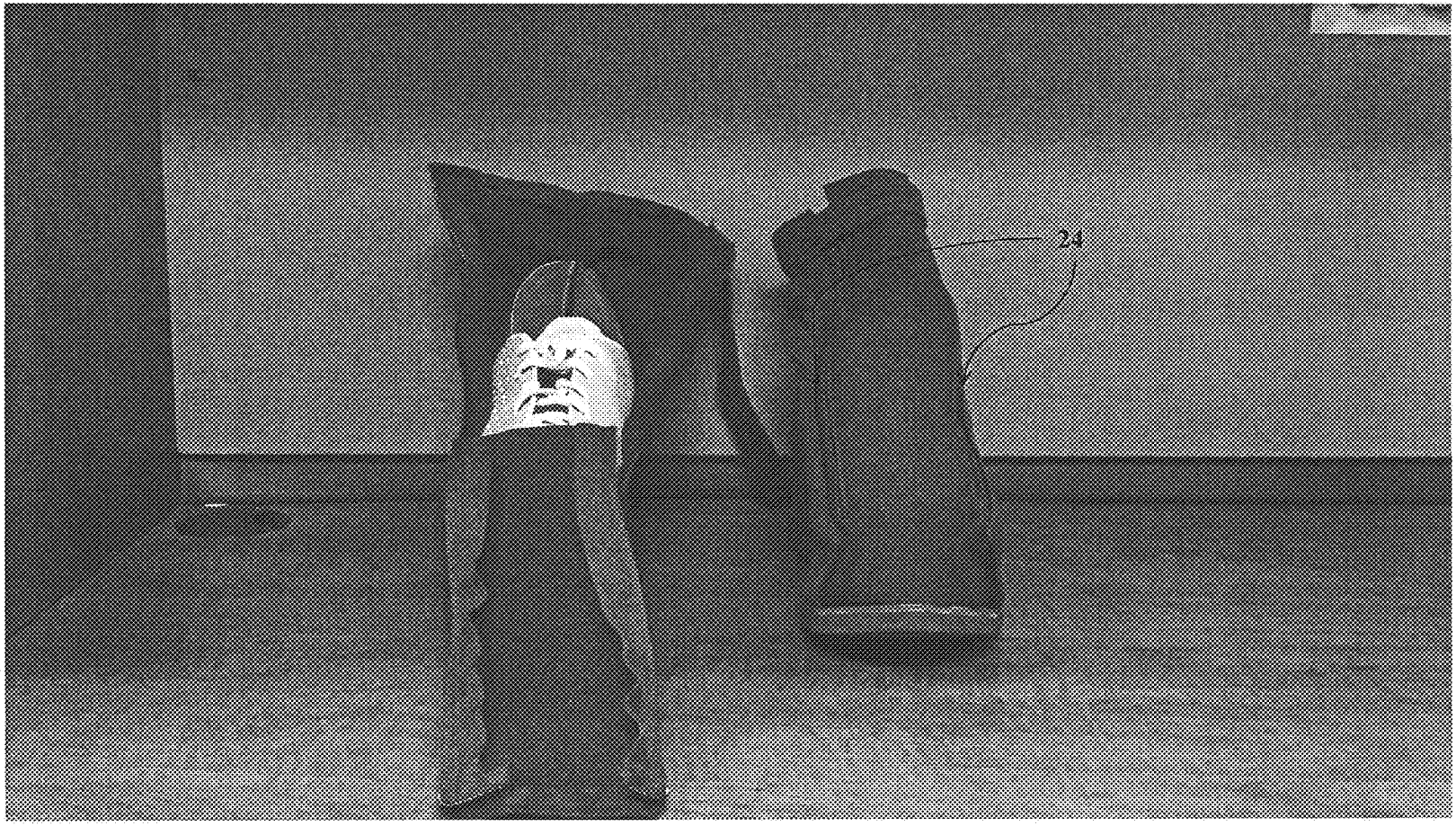
FIG. 2 illustrates a front view of a pair of exemplary protective overshoes in accordance with another aspect of the present invention.
Figure 3:
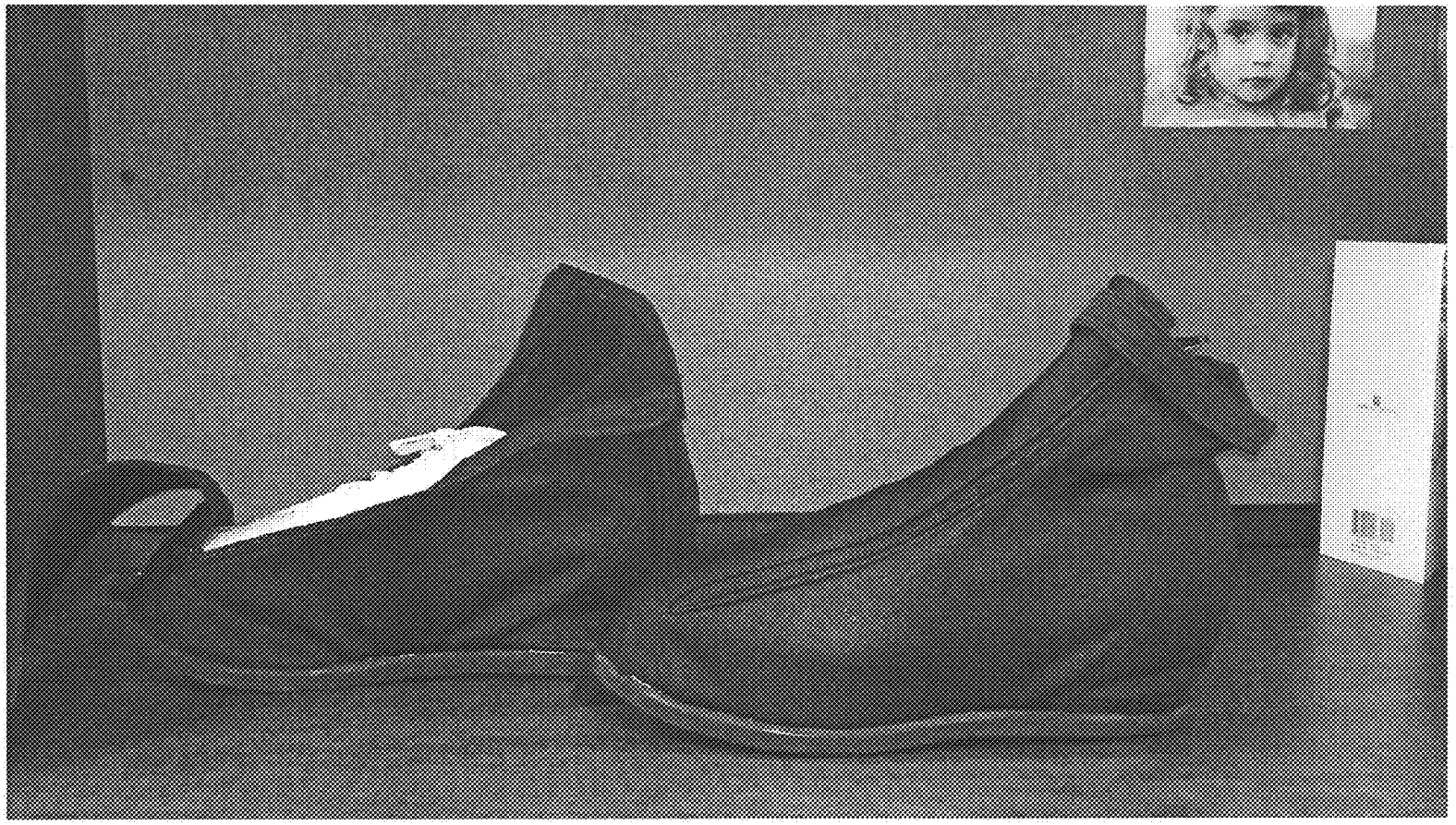
FIG. 3 illustrates a side view of a pair of exemplary protective overshoes in accordance with another aspect of the present invention.
Figure 4:
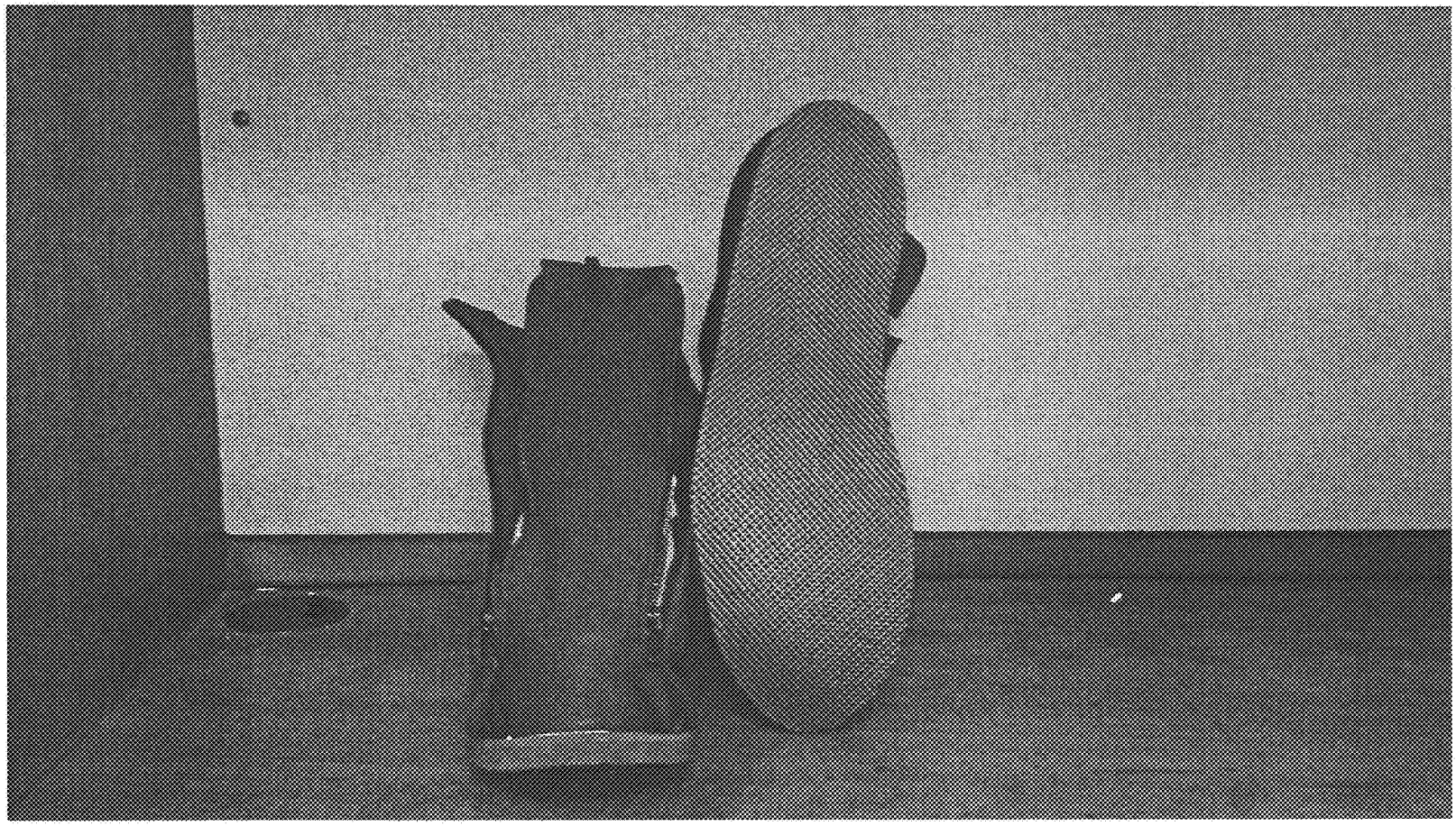
FIG. 4 illustrates a top and bottom view of a pair of exemplary protective overshoes in accordance with another aspect of the present invention.
Figure 5:
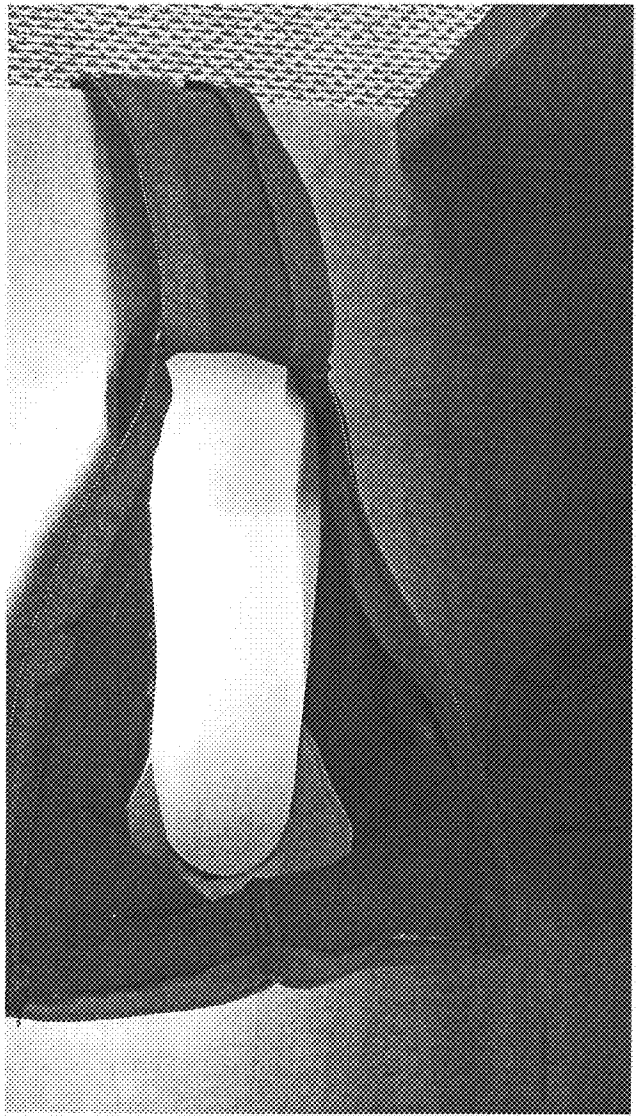
FIG. 5 illustrates the inside of an exemplary protective overshoe in accordance with another aspect of the present invention.

Referring now to the drawings, there is shown in FIG. 1(*a*), an exemplary protective overshoe 10. In the exemplary embodiment of FIG. 1(*a*), the protective overshoe 10 includes a body 11 and a sole 5. In various embodiments, the sole may be integral with the body or a separate piece from the body. The body 11 of the protective overshoe may be formed of any water-proof material such as, for example, rubber, silicone, plastic, and the like. In some exemplary embodiments, the material used to form the protective overshoes contains thermal insulation, such as for example Thinsulate® and polyester fibers, although other insulative materials may alternatively be used. In some exemplary embodiments, the body 11 of the protective overshoe is formed of a rubber material that includes at least 500 grams of Thinsulate®.

The body 11 of the protective overshoe may include an ankle portion 16 that extends up and around a user's ankle, as is illustrated in the Figures. However, the overshoes may alternatively be formed without the ankle portion 16. The protective overshoe 10 may be sized such that it is slightly larger than a corresponding shoe size. Accordingly, the overshoe is able to be sized to fit around any size shoe, while still providing a snug, tight fit.

The protective overshoe 10 includes a front end 12 towards the toe portion of the overshoe and a rear end 14 towards the heel portion. The overshoe may include one or more opening means to allow for quick application and removal of the protective overshoe. In some exemplary embodiments, the opening means includes a zipper, Velcro, bungee cords, laces, buttons, or other enclosure means. For example, the overshoe may include a zipper extending the length of the rear end 12 of the body 11. In some exemplary embodiments, the zipper 1 begins at the ankle portion 16 of the overshoe 10 and extends a length toward the bottom portion 18 of the overshoe 10. In some exemplary embodiments the zipper extends at least ¾ of the length from the ankle portion 16 to the bottom portion 18. However, the zipper 1 may extend any length desired for a particular overshoe design.

FIGS. 2-5 illustrate another exemplary embodiment of the protective overshoe, in which the zippering mechanism is located on the top surface of the overshoe. In the embodiment of FIGS. 2-5, the overshoe 10 includes a double zipper 24, which creates an opening that allows a cleat, or other type of shoe, to easily slip into and out of the overshoe. In some exemplary embodiments, the opening is large enough such that cleats may be inserted into the overshoe without getting caught on the body of the overshoe. The overshoe may alternatively include any number of zippers at any location on the overshoe and the inventive protective overshoe 10 is not limited to the zipper configurations illustrated in the exemplary embodiments.

Referring again to FIGS. 1(*a*) and 1(*b*) the protective overshoe 10 may include one or more tightening means to secure the protective overshoe to a user's foot and/or ankle and additionally provide comfort, sizing control, and ease of fastening. In the illustrated exemplary overshoe 10, the tightening means comprises two Velcro straps 2, 3. Velcro strap 2 is located on the ankle portion and secures the overshoe to the upper ankle, providing a snug fit to keep a foot dry and warm and rain/snow/mud out of the overshoe. Velcro strap 3 helps to secure the protective overshoe 10 to the cleat that is inside the overshoe by tightening the protective overshoe around the cleat. This allows the outer covering to move as one with the cleat and not allow separation in the heal and toe area. The protective overshoe 10 of the present invention may include any number and type of tightening means desired for a particular application. For instance, the overshoe 10 may include only one Velcro strap, or may include more than two straps. Alternatively, or in addition to Velcro straps, the protective overshoes may include other tightening means, such as, for example laces, buttons, bungee cords, draw string adjuster/keeper, belt clips and the like. Such tightening means can be located on any portion of the protective overshoe in various embodiments.

In accordance with some exemplary embodiments, the front end 12 of the protective overshoe 10 includes a toe plate 4. The toe plate reinforces the front end of the protective overshoe 10 and provides stability, durability, and protection. In some embodiments, the toe plate 4 is made out of a rubber or rubber-like material, although the toe plate may comprise any other material desired for a particular application, such as, for example, metal, plastic, fiber composites, rubber, and foam.

The bottom portion 18 of the protective overshoe includes a sole 5, optionally a waterproof sole, for providing traction and comfort. Particularly, the sole 5 may include a gripping mechanism for better traction through muddy and/or slippery terrain. The sole 5 may be of any desired thickness. In some exemplary embodiments, the water-proof sole 5 has a thickness of between about ½ inch and about 1¼ inch. The water-proof sole may comprise a rubber, foam, a combination of rubber and foam, or rubber-like material, although any material known and used in the art may be used.

FIG. 1(*b*) illustrates one exemplary embodiment of a removable sole insert 6 that may be inserted into the protective overshoe 10 prior to use of the overshoe. The sole insert may be formed of any desired material, such as, for example, fiber composites, cloth wrapped foam, plastic or rubber. In the exemplary embodiment illustrated in FIG. 1(*b*), the sole insert 6 comprises a base portion 20 and a foot portion 22. The foot portion 22 may be inserted into the protective overshoe 10, such that the tip of the foot portion 22 meets the toe plate 4 of the protective overshoe. Therefore, the toe plate 4 additionally acts as a stop for the sole insert 6. When inserted into the protective overshoe, the base portion 20 extends the length of the bottom portion 18 of the protective overshoe 10. The base portion 20 may be cushioned and/or insulated to provide added comfort and insulation during use.

The foot portion 22 of the sole insert 6 may include one or more pockets 7 for accepting a heating device 8, such as, for example, disposable warming packets that heat up on demand and last a particular length of time. Alternatively, cooling devices may also be used if desired. A user may activate the heating or cooling device prior to a game or match, such that the overshoes could be ready for use at any time during the game or match. In the exemplary embodiment illustrated in FIG. 1(*b*), the pocket 7 is located on the top of the foot portion 22. However, the pocket may alternatively be located on any area of the foot portion 22. Additionally, more than one pocket may be included on each sole insert 6. The pocket may be formed from any material desired by one skilled in the art, such as, for example, a mesh, cotton, or other heat resistant material. FIG. 1(*b*) includes an exemplary heating device 8, which may provide warmth for up to about 6 hours. Other warmers and cooling devices may be used that provide longer/shorter periods of heating or cooling.

Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. The general inventive concepts are not otherwise limited, except for the recitation of the claims set forth below.

The invention claimed is:

1. A water-proof overshoe comprising:

a body having a foot portion comprising a top side, a bottom side, a toe end, and a heel end opposite the toe end and an ankle portion extending vertically from said foot portion, a sole, wherein said body and said sole collectively form a cavity therebetween, said cavity capable of accepting and fully covering an athletic shoe; and a removable insert having a base portion and a top portion sized to fit inside said cavity, wherein when the removable insert is inserted into the cavity, said base portion extends adjacently to and along the length of said sole and said top portion extends adjacently to and along the top side of said body, such that said cavity remains between said base portion and said top portion, wherein said top portion includes at least one pocket for accepting a warming or cooling device, and wherein said body consists of a single opening means extending from said ankle portion towards said sole, along said heel end of said body at a point furthest from the toe end, a first tightening strap extending horizontally across said ankle portion, separate from said opening means, capable of securing said overshoe to a user's ankle; and a second tightening strap extending horizontally across said top side of said body, separate from said opening means, capable of securing said overshoe to the athletic shoe.

2. The water-proof overshoe of claim 1, wherein said opening means includes one or more of a zipper, fabric hook and loop fastener, elastic, bungee cords, and laces.

3. The water-proof overshoe of claim 2, wherein said opening means is a zipper.

4. The water-proof overshoe of claim 1, wherein said tightening strap includes one or more of a fabric hook and loop fastener, laces, a bungee cord, a draw string adjuster, and a belt clip.

5. The water-proof overshoe of claim 1, wherein said athletic shoe comprises cleats.

6. The water-proof overshoe of claim 1, wherein said body is formed of at least one of rubber, silicone, and plastic.

7. The water-proof overshoe of claim 1, wherein said body further includes an insulative material.

8. The water-proof overshoe of claim 1, wherein said removable sole insert includes a plurality of pockets on said foot covering portion of said sole for accepting a warming or cooling device.

9. The water-proof overshoe of claim 1, wherein said sole is integral with said body.

10. A protective shoe covering comprising:

a waterproof body comprising an ankle portion, a foot portion including a top side and a bottom side, a toe portion, and a heel portion, said toe portion including a reinforced toe plate, wherein said waterproof body portion includes an opening means comprising at least two zippers extending along said top side from said ankle portion to said toe portion and wherein said waterproof body portion further includes at least one tightening strap, separate from said opening means;

a sole portion, wherein said body and said sole collectively form a cavity therebetween, said cavity capable of accepting and fully covering an athletic shoe; and a removable insert having a base portion and a top portion sized to fit inside said cavity, wherein when the removable insert is inserted into the cavity, said base portion extends adjacently to and along the length of said sole and the top portion extends adjacently to and along the top side of said waterproof body, such that said cavity remains between said base portion and said top portion, wherein said top portion includes at least one pocket for accepting a warming or cooling device.

11. The protective shoe covering of claim 10, wherein said opening means includes one or more of a zipper, fabric hook and loop fastener elastic, bungee cords, laces.

12. The protective shoe covering of claim 11, wherein said opening means is a zipper.

13. The protective shoe covering of claim 10, wherein said tightening strap includes one or more of a fabric hook and loop fastener, laces, a bungee cord, a draw string adjuster, and a belt clip.

14. The protective shoe covering of claim 10, wherein said body includes at least two tightening means, separate from said opening means.

15. The protective shoe covering of claim 10, wherein said protective shoe covering is adapted for protecting one or more of cleats, and spikes.

16. The protective shoe covering of claim 10, wherein said reinforced toe plate is formed out of a rubber material.

* * * * *